US010286671B2

(12) United States Patent
Yoda

(10) Patent No.: US 10,286,671 B2
(45) Date of Patent: May 14, 2019

(54) INKJET RECORDING APPARATUS

(71) Applicant: KYOCERA Document Solutions Inc., Osaka-shi, Osaka (JP)

(72) Inventor: Junya Yoda, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/877,719

(22) Filed: Jan. 23, 2018

(65) Prior Publication Data

US 2018/0207940 A1 Jul. 26, 2018

(30) Foreign Application Priority Data

Jan. 26, 2017 (JP) ..... 2017-011925

(51) Int. Cl.
*B41J 2/045* (2006.01)
*B41J 2/175* (2006.01)
*B41J 2/195* (2006.01)

(52) U.S. Cl.
CPC ..... *B41J 2/17513* (2013.01); *B41J 2/04528* (2013.01); *B41J 2/04543* (2013.01); *B41J 2/04551* (2013.01); *B41J 2/04563* (2013.01); *B41J 2/04581* (2013.01); *B41J 2/195* (2013.01)

(58) Field of Classification Search
CPC ..... B41J 2/17513; B41J 2/04528; B41J 2/04551; B41J 2/04543; B41J 2/04581; B41J 2/04563
See application file for complete search history.

(56) References Cited

FOREIGN PATENT DOCUMENTS

EP 1679572 A1 * 7/2006 ..... B41J 2/17593
JP 2011207064 A 10/2011

OTHER PUBLICATIONS

IP.com search (Year: 2018).*
IP.com search (Year: 2019).*

* cited by examiner

*Primary Examiner* — Lisa Solomon
(74) *Attorney, Agent, or Firm* — Alleman Hall Creasman & Tuttle LLP

(57) ABSTRACT

The inkjet recording apparatus includes a recording head, a heater, a first control portion, and a second control portion. The recording head is configured to eject ink toward a sheet. The heater is capable of heating the ink on a supply path for the ink leading from an ink containing portion containing the ink to the recording head. The first control portion is configured to comprehensively control the inkjet recording apparatus, and power supply to the first control portion is stopped when a predetermined power supply stop condition is satisfied. The second control portion includes: a temperature detection portion configured to detect a temperature inside the inkjet recording apparatus; and a heater driving portion configured to drive the heater when the temperature detected by the temperature detection portion has become lower than a predetermined reference temperature, and the second control portion is provided separately from the first control portion.

16 Claims, 5 Drawing Sheets

INKJET RECORDING APPARATUS

INCORPORATION BY REFERENCE

This application is based upon and claims the benefit of priority from the corresponding Japanese Patent Application No. 2017-011925 filed on Jan. 26, 2017, the entire contents of which are incorporated herein by reference.

BACKGROUND

The present disclosure relates to an inkjet recording apparatus.

In the inkjet recording apparatus, ink is ejected from a recording head toward a sheet, whereby an image is formed on the sheet. In the inkjet recording apparatus, when the temperature of the ink changes, the ink ejection amount of the recording head changes due to change in the ink viscosity according to the temperature change, so that the image quality of a printed matter upon printing might be deteriorated. In this regard, there is known a configuration in which driving of a heater for heating the ink is controlled in accordance with the ink temperature detected by a temperature sensor.

SUMMARY

An inkjet recording apparatus according to the present disclosure includes a recording head, a heater, a first control portion, and a second control portion. The recording head is configured to eject ink toward a sheet. The heater is capable of heating the ink on a supply path for the ink leading from an ink containing portion containing the ink to the recording head. The first control portion is configured to comprehensively control the inkjet recording apparatus, and power supply to the first control portion is stopped when a predetermined power supply stop condition is satisfied. The second control portion includes: a temperature detection portion configured to detect a temperature inside the inkjet recording apparatus; and a heater driving portion configured to drive the heater when the temperature detected by the temperature detection portion has become lower than a predetermined reference temperature, and the second control portion is provided separately from the first control portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, with reference to the accompanying drawings, embodiments of the present disclosure will be described for understanding of the present disclosure. The following embodiments are merely examples embodying the present disclosure, and are not intended to limit the technical scope of the present disclosure.

[Schematic Configuration of Inkjet Recording Apparatus 10]

Figure 1:
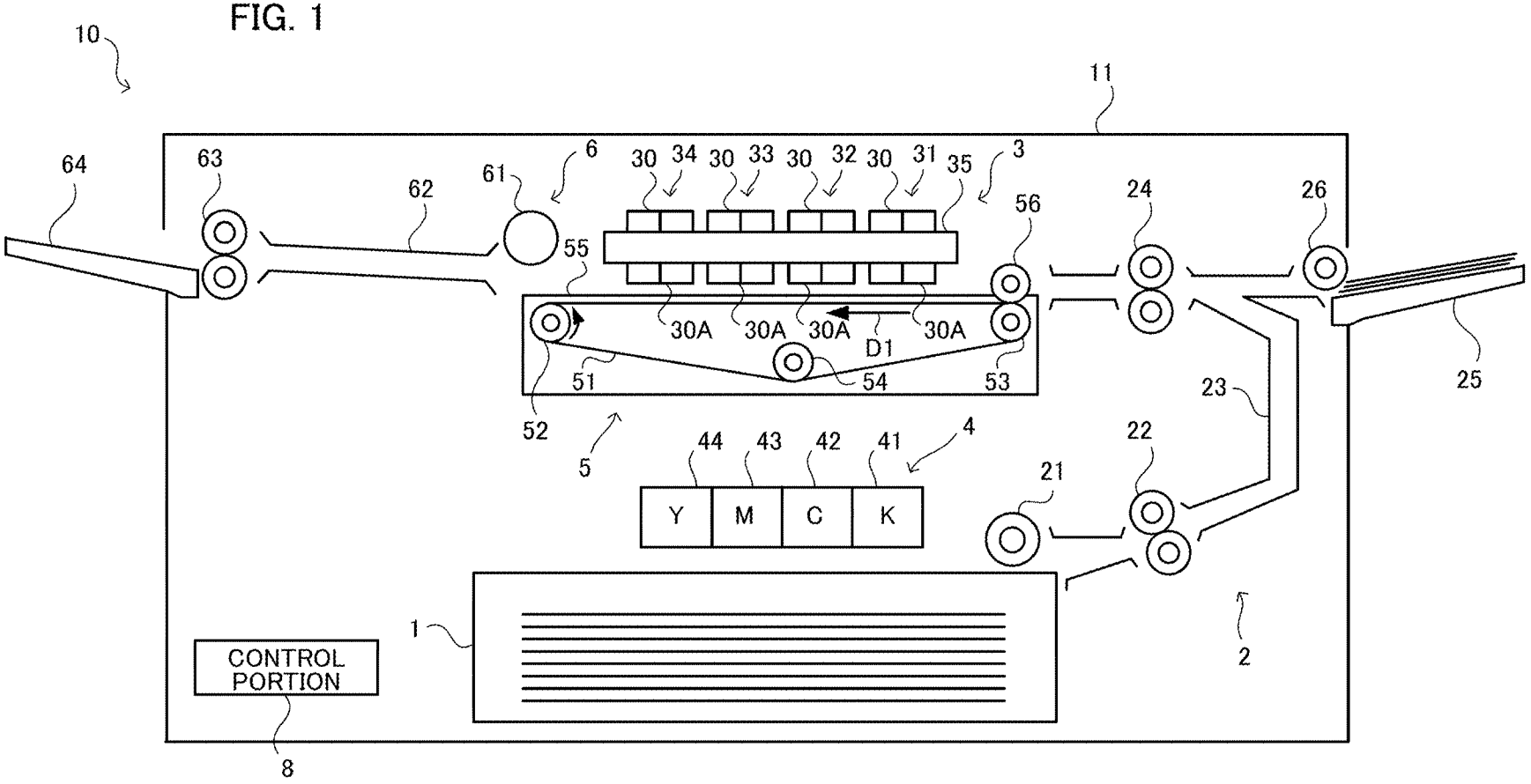
FIG. 1 shows the configuration of an inkjet recording apparatus according to an embodiment of the present disclosure.
Figure 2:
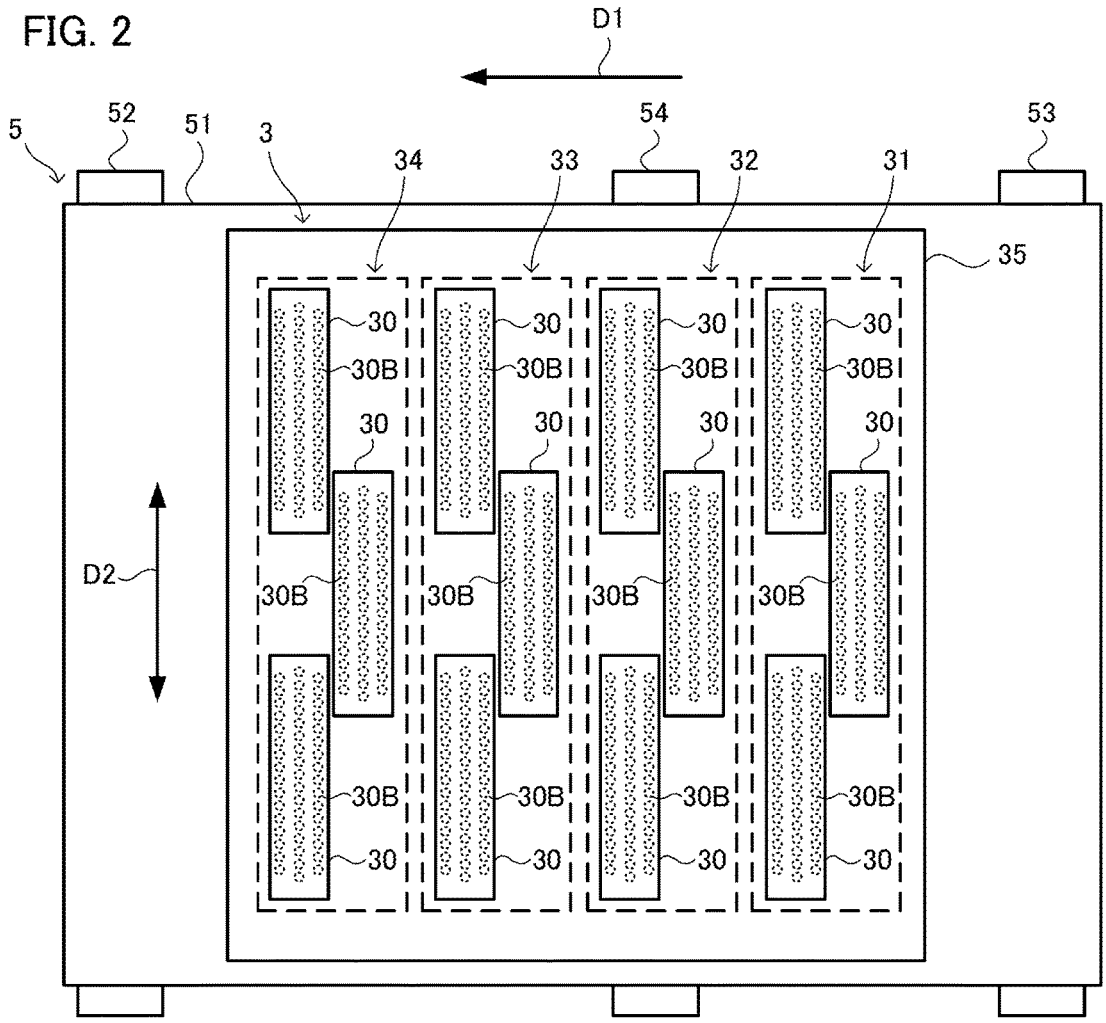
FIG. 2 shows the configuration of a recording portion of the inkjet recording apparatus according to the embodiment of the present disclosure.
Figure 3:
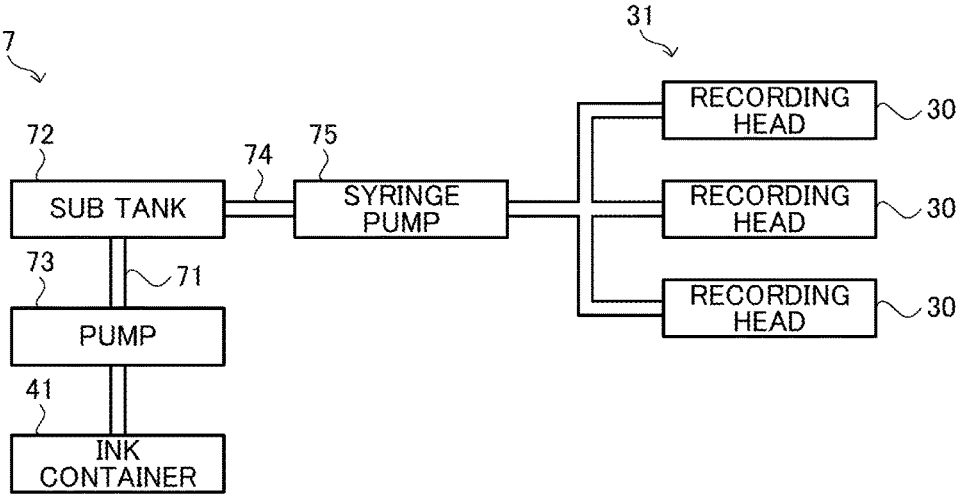
FIG. 3 shows the configuration of an ink supply portion of the inkjet recording apparatus according to the embodiment of the present disclosure.
Figure 4:
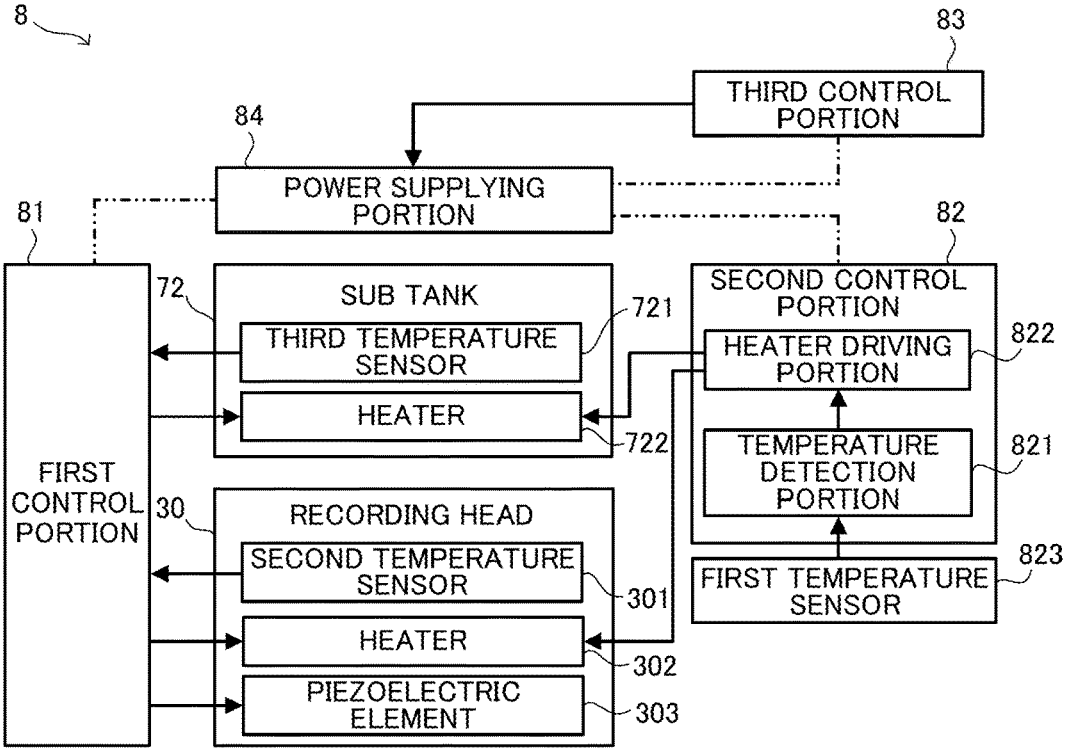
FIG. 4 is a block diagram showing the configuration of a control portion of the inkjet recording apparatus according to the embodiment of the present disclosure.

First, with reference to FIG. 1 to FIG. 4, the schematic configuration of the inkjet recording apparatus 10 according to an embodiment of the present disclosure will be described. Here, FIG. 1 is a schematic sectional view showing the configuration of the inkjet recording apparatus 10. FIG. 2 is a plan view showing the configuration of a recording portion 3. FIG. 3 is a schematic diagram showing the configuration of an ink supply portion 7. In FIG. 4, transmission and reception of electric signals by a first control portion 81, a second control portion 82, and a third control portion 83 are indicated by arrow lines, and power supply paths from a power supplying portion 84 are indicated by two-dot dashed lines.

The inkjet recording apparatus 10 is a printer capable of forming an image by an inkjet method. It is noted that the present disclosure may be applied to inkjet recording apparatuses such as a facsimile device, a copy machine, and a multifunction peripheral capable of forming an image by an inkjet method.

As shown in FIG. 1 and FIG. 3, the inkjet recording apparatus 10 includes a sheet feed cassette 1, a sheet feed portion 2, the recording portion 3, an ink container portion 4, a conveyance unit 5, a sheet discharge portion 6, the ink supply portions 7, and a control portion 8.

In the sheet feed cassette 1, sheets to be printed by the inkjet recording apparatus 10 are stored. For example, the sheets stored in the sheet feed cassette 1 are sheet materials such as paper, coated paper, a postcard, an envelope, and an OHP sheet.

The sheet feed portion 2 feeds a sheet stored in the sheet feed cassette 1 to the recording portion 3. As shown in FIG. 1, the sheet feed portion 2 includes a pickup roller 21, a conveyance roller 22, a conveyance path 23, a registration roller 24, a manual feed tray 25, and a sheet feed roller 26. The pickup roller 21 picks up a sheet one by one from the sheet feed cassette 1. The conveyance roller 22 conveys the sheet picked up by the pickup roller 21 to the registration roller 24. The conveyance path 23 is composed of sheet movement passages from the sheet feed cassette 1 and the manual feed tray 25 to the recording portion 3. The registration roller 24 conveys the sheet to the recording portion 3 at a predetermined conveyance timing (image drawing timing). The manual feed tray 25 and the sheet feed roller 26 are used for feeding sheets from outside.

The recording portion 3 records an image on the sheet fed from the sheet feed portion 2. As shown in FIG. 1, the recording portion 3 includes line heads 31, 32, 33, 34 for respective colors of black, cyan, magenta, and yellow, and a head frame 35 supporting the line heads 31, 32, 33, 34. The head frame 35 is supported by a housing 11 of the inkjet recording apparatus 10. It is noted that the number of the line heads provided to the recording portion 3 may be one or plural other than four.

The line heads 31 to 34 are so-called line-head-type recording heads. That is, the inkjet recording apparatus 10 is a so-called line-head-type inkjet recording apparatus. The line heads 31 to 34 are long in a width direction D2 (see FIG. 2) perpendicular to a sheet conveyance direction D1. Specifically, the line heads 31 to 34 each have a length, in the width direction D2, that corresponds to the width of the maximum-size sheet of sheets that can be stored in the sheet feed cassette 1. The line heads 31 to 34 are fixed to the head frame 35 so as to be separated from each other by a predetermined interval along the sheet conveyance direction D1.

As shown in FIG. 2, the line heads 31 to 34 each have a plurality of recording heads 30. Each recording head 30 ejects ink toward the sheet conveyed by the conveyance unit 5. Specifically, multiple ink-ejection nozzles 30B having openings are provided at an opposed surface 30A (see FIG. 1) of the recording head 30 against the sheet conveyed by the conveyance unit 5. In addition, the recording head 30 includes: pressurizing chambers (not shown) for the respective nozzles 30B; piezoelectric elements 303 (see FIG. 4) provided for the respective pressurizing chambers; and communication flow paths (not shown) communicating with the respective pressurizing chambers. Each piezoelectric element 303 causes ink to be ejected from the nozzle 30B in accordance with application of voltage. Specifically, the piezoelectric element 303 pressurizes the ink contained in the pressurizing chamber, thereby causing the ink to be ejected from the nozzle 30B.

As shown in FIG. 4, each recording head 30 includes a second temperature sensor 301, and a heater 302. The second temperature sensor 301 outputs an electric signal according to the temperature of ink in the communication flow path. The heater 302 is capable of heating the ink in the communication flow path. The second temperature sensor 301 is used for drive control of the piezoelectric element 303 by the control portion 8. In addition, the second temperature sensor 301 is used for drive control of the heater 302 by the control portion 8.

In the present embodiment, in the line head 31, three recording heads 30 are arranged in a staggered form along the width direction D2. In addition, as in the line head 31, also in the other line heads 32 to 34, three recording heads 30 are arranged in a staggered form along the width direction D2. It is noted that FIG. 2 shows a view of the recording portion 3 as seen from the upper side in FIG. 1.

The ink container portion 4 includes ink containers 41, 42, 43, 44 containing inks for respective colors of black, cyan, magenta, and yellow. The ink containers 41 to 44 are connected to the line heads 31 to 34 for their respective corresponding colors, via the ink supply portions 7. Here, each of the ink containers 41 to 44 is an example of an ink containing portion in the present disclosure.

The conveyance unit 5 is located under the line heads 31 to 34. The conveyance unit 5 conveys the sheet while causing the sheet to be opposed to the opposed surfaces 30A of the recording heads 30. As shown in FIG. 1, the conveyance unit 5 includes: a sheet conveyance belt 51 on which the sheet is to be placed; stretch rollers 52 to 54 over which the sheet conveyance belt 51 is stretched; and a conveyance frame 55 supporting these. It is noted that the gap between the sheet conveyance belt 51 and each opposed surface 30A is adjusted so that the gap between the sheet surface and the opposed surface 30A during image recording becomes 1 mm, for example.

The stretch roller 52 is connected to a rotary shaft of a motor (not shown). When the stretch roller 52 is rotated counterclockwise by being driven by the motor, the sheet conveyance belt 51 circulates in such a direction as to allow the sheet to be conveyed in the conveyance direction D1. Thus, the sheet fed from the sheet feed portion 2 is conveyed through the recording portion 3 toward the sheet discharge portion 6 by the circulation of the sheet conveyance belt 51. It is noted that, in order to cause the sheet to be adhered to the sheet conveyance belt 51, a suction unit (not shown) and the like for sucking air from multiple through holes formed in the sheet conveyance belt 51 are also provided to the conveyance unit 5. In addition, a pressure roller 56 for pressing the sheet to the sheet conveyance belt 51 to convey the sheet is provided at a position opposed to the stretch roller 53.

The sheet discharge portion 6 is provided on the downstream side in the conveyance direction D1 with respect to the recording portion 3. As shown in FIG. 1, the sheet discharge portion 6 includes a drying device 61, a conveyance path 62, a sheet discharge roller 63, and a sheet discharge tray 64. The drying device 61 dries the ink adhered to the sheet, by, for example, blowing air to the sheet. Then, the sheet dried by the drying device 61 is fed to the conveyance path 62 and discharged to the sheet discharge tray 64 by the sheet discharge roller 63.

The ink supply portions 7 supply inks contained in the ink container portion 4 to the respective line heads 31 to 34 of the recording portion 3. As shown in FIG. 3, each ink supply portion 7 includes a first supply path 71, a sub tank 72, a pump 73, a second supply path 74, and a syringe pump 75. The ink supply portions 7 are provided for the respective ink containers 41 to 44. It is noted that FIG. 3 shows the ink supply portion 7 corresponding to the ink container 41.

The first supply path 71 is an ink movement passage connecting the ink container 41 and the sub tank 72. The sub tank 72 is provided on an ink supply path leading from the ink container 41 to the line head 31, and stores ink. The sub tank 72 has, at the upper part thereof, a vent hole communicating with outside, so that the air pressure in the space above the liquid level of the ink stored inside becomes the same as the atmospheric pressure. The sub tank 72 is provided at a position above the ink container 41. The pump 73 is provided on the first supply path 71, and pumps up the ink contained in the ink container 41 to supply the ink to the sub tank 72. The sub tank 72 is provided with a sensor (not shown) for detecting the liquid level of the ink at a predetermined reference position. In the inkjet recording apparatus 10, on the basis of the detection result from the sensor, the amount of ink supplied from the pump 73 is controlled so that the liquid level of the ink stored in the sub tank 72 falls within a predetermined range from the reference position. The second supply path 74 is an ink movement passage connecting the sub tank 72 and the communication flow path of each recording head 30. In the inkjet recording apparatus 10, the sub tank 72 is located such that the reference position in the sub tank 72 is separated downward from the opposed surface 30A of the recording head 30 by a predetermined distance. Thus, a negative pressure state is formed in each nozzle 30B of the recording head 30. The syringe pump 75 is provided on the second supply path 74. The syringe pump 75 is used for operations such as purge operation of discharging the ink from each nozzle 30B of the recording head 30.

As shown in FIG. 4, the sub tank 72 includes a third temperature sensor 721 and a heater 722. The third temperature sensor 721 outputs an electric signal according to the temperature of the ink in the sub tank 72. The heater 722 is capable of heating the ink in the sub tank 72. The third temperature sensor 721 is used for drive control of the heater 722 by the control portion 8. Here, the sub tank 72 is an example of an intermediate storage portion in the present disclosure.

In the inkjet recording apparatus 10, when the temperature of the ink changes, the ink ejection amount of the recording head 30 changes due to change in the ink viscosity according to the temperature change, so that the image quality of the printed matter upon printing is deteriorated. In this regard, there is known a configuration in which driving of the heater for heating the ink is controlled in accordance with the ink temperature detected by the temperature sensor.

In the inkjet recording apparatus 10, as described later, the operation mode shifts from a normal mode to a standby mode in which power consumption is less than that in the normal mode, in accordance with a user's operation to a main power switch (not shown), or the like. In the inkjet recording apparatus 10, drive control for the heater 302 and the heater 722 is executed during the standby mode so that printing can be performed immediately after restoration to the normal mode from the standby mode. Here, in the case where the drive control for the heater 302 and the heater 722 during the standby mode is executed by a main control portion which comprehensively controls the inkjet recording apparatus 10, it is necessary to continue supplying power to the main control portion even during the standby mode.

In this regard, in the inkjet recording apparatus 10 according to the embodiment of the present disclosure, it is possible to reduce power consumption during the standby mode, as described below.

Hereinafter, with reference to FIG. 4, the control portion 8 will be described. As shown in FIG. 4, the control portion 8 includes the first control portion 81, the second control portion 82, the third control portion 83, and the power supplying portion 84.

The first control portion 81 comprehensively controls the inkjet recording apparatus 10. The first control portion 81 includes control devices such as a CPU, a ROM, and a RAM (not shown). The CPU is a processor that executes various calculation processes. The ROM is a nonvolatile storage device in which information such as a control program for causing the CPU to execute various processes is stored in advance. The RAM is a volatile storage device used as a temporary storage memory (working area) for various processes to be executed by the CPU. In the first control portion 81, various control programs stored in the ROM in advance are executed by the CPU. Thus, the inkjet recording apparatus 10 is comprehensively controlled by the first control portion 81.

The first control portion 81 controls application voltage applied to the piezoelectric element 303, on the basis of an electric signal outputted from the second temperature sensor 301. For example, in the inkjet recording apparatus 10, table data in which the application voltage and the ink temperature detected by the second temperature sensor 301 are associated with each other, is stored in the ROM in advance. The first control portion 81 sets the application voltage on the basis of the table data and the ink temperature detected by the second temperature sensor 301. Thus, the ejection amount of ink from the nozzle 30B is kept constant irrespective of the ink temperature, whereby reduction in the image quality of a printed matter due to change in the ink temperature is suppressed.

Here, in the case where the ink temperature is lower than the temperature corresponding to the upper limit value of the application voltage, the ejection amount of ink from the nozzle 30B cannot be kept constant, and thus the image quality of the printed matter is reduced. For example, in the inkjet recording apparatus 10, the temperature corresponding to the upper limit value of the application voltage is 18 degrees. In this regard, in the inkjet recording apparatus 10, the first control portion 81 executes the first drive control process for controlling the driving of the heater 302 and the heater 722 on the basis of electric signals outputted from the second temperature sensor 301 and the third temperature sensor 721.

Specifically, when the ink temperature detected by the second temperature sensor 301 has become lower than a predetermined reference temperature, the first control portion 81 drives the heater 302. For example, the reference temperature is 18 degrees equal to the temperature corresponding to the upper limit value of the application voltage, or is a higher temperature. In addition, when the ink temperature detected by the second temperature sensor 301 has become higher than a predetermined specific temperature which is higher than the reference temperature, the first control portion 81 stops the driving of the heater 302. For example, the specific temperature is 25 degrees. It is noted that the first control portion 81 may stop the driving of the heater 302 when another condition is satisfied in which, for example, a predetermined time period elapses from the time of driving the heater 302.

In addition, when the ink temperature detected by the third temperature sensor 721 has become lower than the reference temperature, the first control portion 81 drives the heater 722. In addition, when the ink temperature detected by the third temperature sensor 721 has become higher than the specific temperature, the first control portion 81 stops the driving of the heater 722.

It is noted that, in the inkjet recording apparatus 10, the application voltage control by the first control portion 81 in accordance with the ink temperature detected by the second temperature sensor 301 may not be executed.

The third control portion 83 is capable of executing data communication with an external communication device. Specifically, the third control portion 83 controls a communication interface (not shown) to execute data communication with an external communication device. For example, the third control portion 83 is configured from an electronic circuit such as an integrated circuit (ASIC, DSP).

In addition, the third control portion 83 executes a mode shift process for switching the operation mode of the inkjet recording apparatus 10.

Specifically, when a predetermined power supply stop condition is satisfied, the third control portion 83 shifts the operation mode of the inkjet recording apparatus 10 from the normal mode to the standby mode. Examples of the power supply stop condition include the following: a state in which no operation is performed to an operation portion (not shown) continues during a predetermined time period; and the main power switch is operated.

For example, when the power supply stop condition is satisfied, the third control portion 83 causes the power supplying portion 84 to stop supplying power to components of the inkjet recording apparatus 10 including the first control portion 81, except for some components including the third control portion 83. That is, in the inkjet recording apparatus 10, when the operation mode of the inkjet recording apparatus 10 is the standby mode, the first control portion 81 goes into a stopped state by stoppage of power supply from the power supplying portion 84. In addition, when the power supply stop condition is satisfied, the third control portion 83 causes the power supplying portion 84 to start supplying power to the second control portion 82.

When a predetermined power supply restart condition is satisfied, the third control portion 83 shifts the operation mode of the inkjet recording apparatus 10 from the standby mode to the normal mode. Examples of the power supply restart condition include the following: the operation portion or the main power switch is operated; and a print job is received from an external communication device.

For example, when the power supply restart condition is satisfied, the third control portion 83 causes the power supplying portion 84 to restart supplying power to components of the inkjet recording apparatus 10 including the first control portion 81. In addition, when the power supply restart condition is satisfied, the third control portion 83 causes the power supplying portion 84 to stop supplying power to the second control portion 82. That is, in the inkjet recording apparatus 10, the second control portion 82 receives power supply from the power supplying portion 84 only when the operation mode of the inkjet recording apparatus 10 is the standby mode. It is noted that the second control portion 82 may receive power supply from the power supplying portion 84 also when the operation mode of the inkjet recording apparatus 10 is the normal mode.

The second control portion 82 is a control portion provided separately from the first control portion 81. Specifically, the second control portion 82 is configured from an electronic circuit such as an integrated circuit (ASIC, DSP).

When the operation mode is the standby mode, the second control portion 82 executes a second drive control process for controlling the driving of the heater 302 and the heater 722. As shown in FIG. 4, the second control portion 82 includes a temperature detection portion 821 and a heater driving portion 822.

The temperature detection portion 821 detects the temperature inside the inkjet recording apparatus 10. Specifically, the inkjet recording apparatus 10 is provided with a first temperature sensor 823 (see FIG. 4) used for detecting the temperature inside the inkjet recording apparatus 10. For example, the first temperature sensor 823 is provided at a position separated by a predetermined specific distance or longer from each recording head 30 of the line heads 31 to 34 inside the housing 11 of the inkjet recording apparatus 10, and outputs an electric signal according to the temperature at the provided position. For example, the specific distance is 10 centimeters. The temperature detection portion 821 detects the temperature inside the inkjet recording apparatus 10 on the basis of the electric signal outputted from the first temperature sensor 823. It is noted that the temperature detection portion 821 may detect the temperature inside the inkjet recording apparatus 10, using the second temperature sensor 301 corresponding to any of the recording heads 30.

When the temperature detected by the temperature detection portion 821 has become lower than the reference temperature, the heater driving portion 822 drives the heater 302 and the heater 722. In addition, when a predetermined driving stop condition is satisfied, the heater driving portion 822 stops the driving of the heater 302 and the heater 722. For example, the driving stop condition is that the detected temperature becomes higher than the specific temperature. It is noted that the driving stop condition may be that a predetermined specific time period elapses from the time of driving the heater 302 and the heater 722, or may be another condition.

The power supplying portion 84 supplies power supplied from an external commercial power supply, to components of the inkjet recording apparatus 10. For example, the power supplying portion 84 is an AC-DC converter that converts AC voltage supplied from the external commercial power supply, into DC voltage.

[First Drive Control Process]

Figure 5:
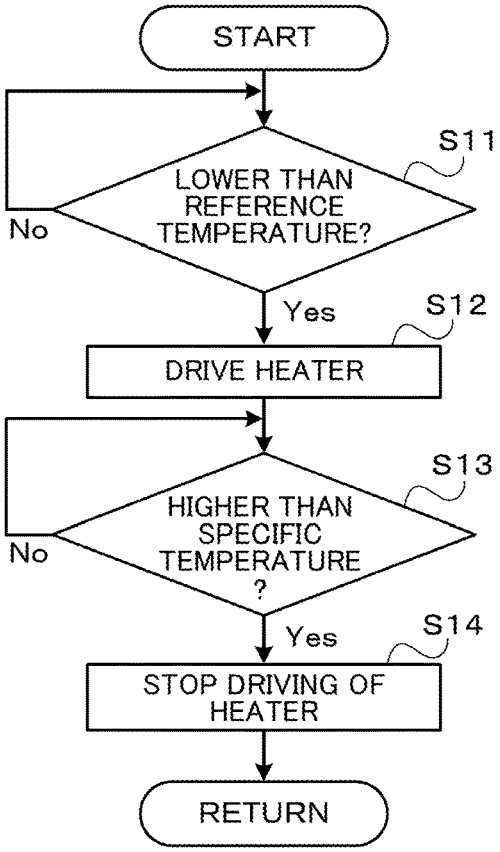
FIG. 5 is a flowchart showing an example of a first drive control process executed by the inkjet recording apparatus according to the embodiment of the present disclosure.

Hereinafter, with reference to FIG. 5, an example of the procedure of the first drive control process executed by the first control portion 81 in the inkjet recording apparatus 10 will be described. Here, steps S11, S12, . . . denote the numbers of steps in the processing procedure executed by the first control portion 81. It is noted that the first control portion 81 executes the first drive control process for each recording head 30 individually. In addition, the first control portion 81 executes the first drive control process for each sub tank 72 individually. Hereinafter, the first drive control process executed for one recording head 30 will be described.

<Step S11>

First, in step S11, the first control portion 81 determines whether or not the ink temperature detected by the second temperature sensor 301 is lower than the reference temperature.

Here, if the first control portion 81 determines that the ink temperature detected by the second temperature sensor 301 is lower than the reference temperature (Yes in S11), the first control portion 81 shifts the process to step S12. On the other hand, if the ink temperature detected by the second temperature sensor 301 is not lower than the reference temperature (No in S11), the first control portion 81 waits in step S11 until the ink temperature detected by the second temperature sensor 301 becomes lower than the reference temperature.

<Step S12>

In step S12, the first control portion 81 drives the heater 302.

<Step S13>

In step S13, the first control portion 81 determines whether or not the ink temperature detected by the second temperature sensor 301 is higher than the specific temperature.

Here, if the first control portion 81 determines that the ink temperature detected by the second temperature sensor 301 is higher than the specific temperature (Yes in S13), the first control portion 81 shifts the process to step S14. On the other hand, if the ink temperature detected by the second temperature sensor 301 is not higher than the specific temperature (No in S13), the first control portion 81 waits in step S13 until the ink temperature detected by the second temperature sensor 301 becomes higher than the specific temperature.

<Step S14>

In step S14, the first control portion 81 stops the driving of the heater 302.

[Mode Shift Process]

Figure 6:
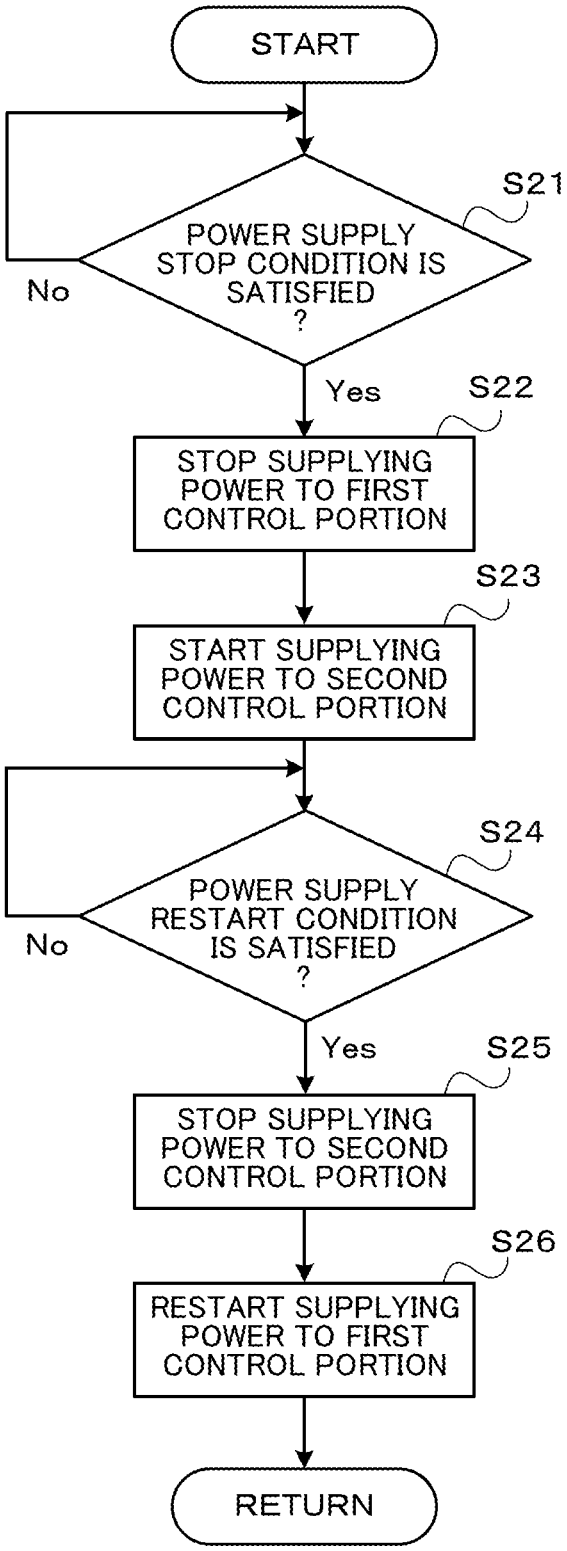
FIG. 6 is a flowchart showing an example of a mode shift process executed by the inkjet recording apparatus according to the embodiment of the present disclosure.

Next, with reference to FIG. 6, an example of the procedure of the mode shift process executed by the third control portion 83 in the inkjet recording apparatus 10 will be described.

<Step S21>

First, in step S21, the third control portion 83 determines whether or not the power supply stop condition is satisfied.

Here, if the third control portion 83 determines that the power supply stop condition is satisfied (Yes in S21), the third control portion 83 shifts the process to step S22. On the other hand, if the power supply stop condition is not satisfied (No in S21), the third control portion 83 waits in step S21 until the power supply stop condition is satisfied.

<Step S22>

In step S22, the third control portion 83 causes the power supplying portion 84 to stop supplying power to components of the inkjet recording apparatus 10 including the first control portion 81.

<Step S23>

In step S23, the third control portion 83 causes the power supplying portion 84 to start to supply power to the second control portion 82. Thus, the main part for drive control of the heater 302 and the heater 722 is switched from the first control portion 81 to the second control portion 82.

<Step S24>

In step S24, the third control portion 83 determines whether or not the power supply restart condition is satisfied.

Here, if the third control portion 83 determines that the power supply restart condition is satisfied (Yes in S24), the third control portion 83 shifts the process to step S25. On the other hand, if the power supply restart condition is not satisfied (No in S24), the third control portion 83 waits in step S24 until the power supply restart condition is satisfied.

<Step S25>

In step S25, the third control portion 83 causes the power supplying portion 84 to stop supplying power to the second control portion 82.

<Step S26>

In step S26, the third control portion 83 causes the power supplying portion 84 to restart supplying power to components of the inkjet recording apparatus 10 including the first control portion 81. Thus, the main part for drive control of the heater 302 and the heater 722 is switched from the second control portion 82 to the first control portion 81.

[Second Drive Control Process]

Figure 7:
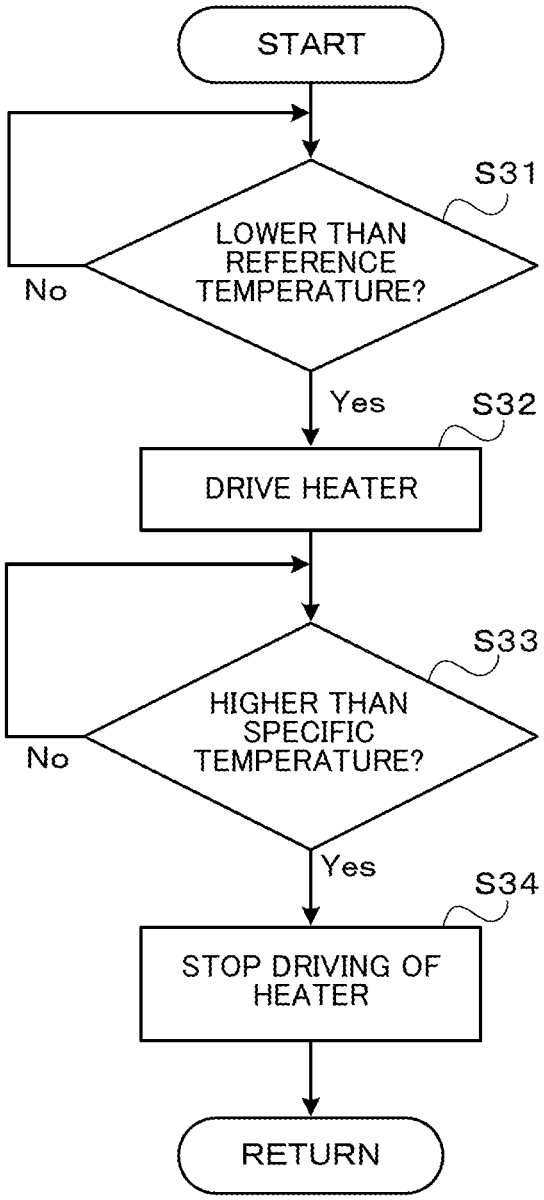
FIG. 7 is a flowchart showing an example of a second drive control process executed by the inkjet recording apparatus according to the embodiment of the present disclosure.

Next, with reference to FIG. 7, an example of the procedure of the second drive control process executed by the second control portion 82 in the inkjet recording apparatus 10 will be described.

<Step S31>

First, in step S31, the second control portion 82 determines whether or not the temperature inside the inkjet recording apparatus 10 detected by the first temperature sensor 823 is lower than the reference temperature.

Here, if the second control portion 82 determines that the temperature inside the inkjet recording apparatus 10 detected by the first temperature sensor 823 is lower than the reference temperature (Yes in S31), the second control portion 82 shifts the process to step S32. On the other hand, if the temperature inside the inkjet recording apparatus 10 detected by the first temperature sensor 823 is not lower than the reference temperature (No in S31), the second control portion 82 waits in step S31 until the temperature inside the inkjet recording apparatus 10 detected by the first temperature sensor 823 becomes lower than the reference temperature.

<Step S32>

In step S32, the second control portion 82 drives the heater 302 and the heater 722.

Here, in the inkjet recording apparatus 10, the first temperature sensor 823 is provided at a position separated by the specific distance or longer from each recording head 30 of the line heads 31 to 34. Thus, delay of the drive start timing of the heater 302 and the heater 722 is avoided as compared to a configuration in which the second control portion 82 executes the drive control for the heater 302 and the heater 722 on the basis of the second temperature sensor 301 provided for a specific recording head 30. Specifically, in the case where the operation mode shifts to the standby mode after only the line head including the specific recording head 30 is used for printing, it is possible to avoid the situation in which, even though the temperature of the ink in the recording head 30 included in another line head is lower than the reference temperature, driving of the heater 302 and the heater 722 is not started because the temperature of the ink in the specific recording head 30 is lower than the reference temperature.

<Step S33>

In step S33, the second control portion 82 determines whether or not the temperature inside the inkjet recording apparatus 10 detected by the first temperature sensor 823 is higher than the specific temperature.

Here, if the second control portion 82 determines that the temperature inside the inkjet recording apparatus 10 detected by the first temperature sensor 823 is higher than the specific temperature (Yes in S33), the second control portion 82 shifts the process to step S34. On the other hand, if the temperature inside the inkjet recording apparatus 10 detected by the first temperature sensor 823 is not higher than the specific temperature (No in S33), the second control portion 82 waits in step S33 until the temperature inside the inkjet recording apparatus 10 detected by the first temperature sensor 823 becomes higher than the specific temperature.

<Step S34>

In step S34, the second control portion 82 stops the driving of the heater 302 and the heater 722.

As described above, the inkjet recording apparatus 10 is provided with the second control portion 82 that executes drive control for the heater 302 and the heater 722 when the operation mode is the standby mode. Thus, when the operation mode of the inkjet recording apparatus 10 is the standby mode, it is possible to stop supplying power to the first control portion 81 which functions as a main control portion for comprehensively controlling the inkjet recording apparatus 10. Therefore, it is possible to reduce power consumption during the standby mode.

It is noted that, in the inkjet recording apparatus 10, an ink circulation path passing through the sub tank 72 and the recording head 30 may be formed, and the ink may circulate in the ink circulation path in the standby mode. In this case, the heater of the present disclosure may be provided at any position in the ink circulation path.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a recording head configured to eject ink toward a sheet;

a heater capable of heating the ink on a supply path for the ink leading from an ink containing portion containing the ink to the recording head;

a first control portion which is configured to comprehensively control the inkjet recording apparatus, and to which power supply is stopped when a predetermined power supply stop condition is satisfied; and a second control portion including: a temperature detection portion configured to detect a temperature inside the inkjet recording apparatus; and a heater driving portion configured to drive the heater when the temperature detected by the temperature detection portion has become lower than a predetermined reference temperature, the second control portion being provided separately from the first control portion, wherein the second control portion stops driving of the heater when a predetermined driving stop condition is satisfied.

2. The inkjet recording apparatus according to claim 1, wherein the driving stop condition includes that the temperature detected by the temperature detection portion becomes higher than a predetermined specific temperature which is higher than the reference temperature, or that a predetermined specific time period elapses from a time of driving the heater.

3. The inkjet recording apparatus according to claim 1, wherein the second control portion is supplied with power only while power supply to the first control portion is being stopped.

4. The inkjet recording apparatus according to claim 1, wherein the recording head is one of a plurality of recording heads, and wherein the inkjet recording apparatus further comprises:

the plurality of the recording heads; and a first temperature sensor provided so as to be separated from each recording head of the plurality of the recording heads by a predetermined specific distance or longer, the first temperature sensor being configured to output an electric signal according to a temperature at a position where the first temperature sensor is provided, wherein the temperature detection portion detects the temperature inside the inkjet recording apparatus on the basis of the electric signal outputted from the first temperature sensor.

5. The inkjet recording apparatus according to claim 1, further comprising a second temperature sensor provided to the recording head and configured to output an electric signal according to a temperature of the ink, wherein the recording head ejects the ink, using a piezoelectric element, and the first control portion controls application voltage applied to the piezoelectric element, on the basis of the electric signal outputted from the second temperature sensor.

6. The inkjet recording apparatus according to claim 1, further comprising an intermediate storage portion provided on the supply path and storing the ink, wherein the heater is provided to the recording head and the intermediate storage portion.

7. An inkjet recording apparatus comprising:

a recording head configured to eject ink toward a sheet;

a heater capable of heating the ink on a supply path for the ink leading from an ink containing portion containing the ink to the recording head;

a first control portion which is configured to comprehensively control the inkjet recording apparatus, and to which power supply is stopped when a predetermined power supply stop condition is satisfied; and a second control portion including: a temperature detection portion configured to detect a temperature inside the inkjet recording apparatus; and a heater driving portion configured to drive the heater when the temperature detected by the temperature detection portion has become lower than a predetermined reference temperature, the second control portion being provided separately from the first control portion, wherein the second control portion is supplied with power only while power supply to the first control portion is being stopped.

8. The inkjet recording apparatus according to claim 7, wherein the recording head is one of a plurality of recording heads, and wherein the inkjet recording apparatus further comprises:

the plurality of the recording heads; and a first temperature sensor provided so as to be separated from each recording head of the plurality of the recording heads by a predetermined specific distance or longer, the first temperature sensor being configured to output an electric signal according to a temperature at a position where the first temperature sensor is provided, wherein the temperature detection portion detects the temperature inside the inkjet recording apparatus on the basis of the electric signal outputted from the first temperature sensor.

9. The inkjet recording apparatus according to claim 7, further comprising a second temperature sensor provided to the recording head and configured to output an electric signal according to a temperature of the ink, wherein the recording head ejects the ink, using a piezoelectric element, and the first control portion controls application voltage applied to the piezoelectric element, on the basis of the electric signal outputted from the second temperature sensor.

10. The inkjet recording apparatus according to claim 7, further comprising an intermediate storage portion provided on the supply path and storing the ink, wherein the heater is provided to the recording head and the intermediate storage portion.

11. An inkjet recording apparatus comprising:

a plurality of recording heads configured to eject ink toward a sheet;

a heater capable of heating the ink on a supply path for the ink leading from an ink containing portion containing the ink to at least one of the plurality of the recording heads;

a first control portion which is configured to comprehensively control the inkjet recording apparatus, and to which power supply is stopped when a predetermined power supply stop condition is satisfied;

a second control portion including: a temperature detection portion configured to detect a temperature inside the inkjet recording apparatus; and a heater driving portion configured to drive the heater when the temperature detected by the temperature detection portion has become lower than a predetermined reference temperature, the second control portion being provided separately from the first control portion; and a first temperature sensor provided so as to be separated from each recording head of the plurality of the recording heads by a predetermined specific distance or longer, the first temperature sensor being configured to output an electric signal according to a temperature at a position where the first temperature sensor is provided, wherein the temperature detection portion detects the temperature inside the inkjet recording apparatus on the basis of the electric signal outputted from the first temperature sensor.

12. The inkjet recording apparatus according to claim 11, further comprising a second temperature sensor provided to the at least one of the plurality of the recording heads and configured to output an electric signal according to a temperature of the ink, wherein the at least one of the plurality of the recording heads ejects the ink, using a piezoelectric element, and the first control portion controls application voltage applied to the piezoelectric element, on the basis of the electric signal outputted from the second temperature sensor.

13. The inkjet recording apparatus according to claim 11, further comprising an intermediate storage portion provided on the supply path and storing the ink, wherein the heater is provided to the at least one of the plurality of the recording heads and the intermediate storage portion.

14. An inkjet recording apparatus comprising:

a recording head configured to eject ink toward a sheet;

a heater capable of heating the ink on a supply path for the ink leading from an ink containing portion containing the ink to the recording head;

a first control portion which is configured to comprehensively control the inkjet recording apparatus, and to which power supply is stopped when a predetermined power supply stop condition is satisfied;

a second control portion including: a temperature detection portion configured to detect a temperature inside the inkjet recording apparatus; and a heater driving portion configured to drive the heater when the temperature detected by the temperature detection portion has become lower than a predetermined reference temperature, the second control portion being provided separately from the first control portion; and a second temperature sensor provided to the recording head and configured to output an electric signal according to a temperature of the ink, wherein the recording head ejects the ink, using a piezoelectric element, and the first control portion controls application voltage applied to the piezoelectric element, on the basis of the electric signal outputted from the second temperature sensor.

15. The inkjet recording apparatus according to claim 14, further comprising an intermediate storage portion provided on the supply path and storing the ink, wherein the heater is provided to the recording head and the intermediate storage portion.

16. An inkjet recording apparatus comprising:

a recording head configured to eject ink toward a sheet;

a heater capable of heating the ink on a supply path for the ink leading from an ink containing portion containing the ink to the recording head;

a first control portion which is configured to comprehensively control the inkjet recording apparatus, and to which power supply is stopped when a predetermined power supply stop condition is satisfied;

a second control portion including: a temperature detection portion configured to detect a temperature inside the inkjet recording apparatus; and a heater driving portion configured to drive the heater when the temperature detected by the temperature detection portion has become lower than a predetermined reference temperature, the second control portion being provided separately from the first control portion; and an intermediate storage portion provided on the supply path and storing the ink, wherein the heater is provided to the recording head and the intermediate storage portion.

* * * * *